United States Patent [19]

Büttner et al.

[11] 3,999,289

[45] Dec. 28, 1976

[54] METHOD OF PREPARING CABLE ENDS

[75] Inventors: Karl Büttner; Jürgen Böll; Kurt Wölfel, all of Nurnberg, Germany

[73] Assignee: Kabel-und Metallwerke Gutehoffnungshutte Aktiengesellschaft, Hannover, Germany

[22] Filed: Aug. 18, 1975

[21] Appl. No.: 605,748

[30] Foreign Application Priority Data

Aug. 22, 1974 Germany ..... 2440264

[52] U.S. Cl. ..... 29/628; 29/203 DT; 29/206 D

[51] Int. Cl.[2] ..... H01R 43/00

[58] Field of Search ..... 29/628, 33 M, 203 D, 29/203 DT, 203 C, 206

[56] References Cited

UNITED STATES PATENTS 3,444,618 5/1969 Sorlie ..... 29/206 X

FOREIGN PATENTS OR APPLICATIONS 712,753 7/1965 Canada ..... 29/203 DT

*Primary Examiner*—Victor A. DiPalma
*Attorney, Agent, or Firm*—Ralf H. Siegemund

[57] ABSTRACT

Cable lengths are prepared for extruding a plug at the end in that the lengths are stepwise moved through stations, in which each cable length is turned and oriented as to its leads; the lead ends are stripped, tin-plated and shaped in sequential stations followed by connecting preassembled contact prongs to the lead ends. The plug body is then extruded around the prong-lead connections. The lead orientation is electro-optically servo-controlled and the prong to lead connection is made by a funnel for threading the leads into the hollow prongs followed by squeezing the prongs to fasten the leads thereto.

9 Claims, 8 Drawing Figures

METHOD OF PREPARING CABLE ENDS

BACKGROUND OF THE INVENTION

The present invention relates to the providing of plug elements respectively to lengths of electrical conductors of cable having a plurality of leads and wherein such a plug is to have the corresponding number of pins or prongs. More particularly, the invention relates to the preparation of a cable length for extruding a plug element to one of its ends.

A plug element to be made may consist basically of an insulative holding bridge or the like supporting the contact prongs or pins, and a body embeds this holder as well as the connections between leads and pins. The equipment for making such a plug element usually includes a station in which particular lengths are sequentially cut from a long cable. Subsequently, the insulative jacket around the respective insulated leads must be removed from one end of each length as it leaves the cutter. The other end remains as is or is otherwise prepared. The prongs are connected to the lead ends and the plug is extruded at that one end of the length around the connection of leads and prongs. The resulting product is then provided to electrical equipment manufacturers who connect the free end of the cable to the their equipment.

Prior to extrusion, but following the removal of the insulation jacket, the cable length end must be prepared additionally in that insulation must be stripped off the wire leads and their tips must be strengthened; tension relief may be included in the assembly prior to extruding the plug body around the connection.

The assembly and preparation has been heretofore rather cumbersome and was not very economical even though automation has been employed to a limited extent.

DESCRIPTION OF THE INVENTION

It is an object of the present invention to prepare lengths of cable for extruding plug bodies at their ends (one or both as the case requires).

In accordance with the preferred embodiments of the invention, it is suggested to provide for stepwise movement of the individual lengths past several stations whereby the individual lengths are preferably held in transverse, stretched configuration. In the first station, the cable is turned until the leads have a particular, straight orientation, parallel to each other. In the next station the insulation is stripped off, an end portion of the individual leads and in the next station thereafter the tips are strengthened, e.g., dip-coated. If stripping was carried out only to the extent needed to expose the tips to the coating, additional insulation stripping may be needed thereafter, because in the next station the lead ends are shaped, so that the tips have position for connection to contact prongs or pins, e.g., inserting them into tubular prongs or pins in the next station thereafter. These prongs or pins may have been preassembled in a holder. The thus treated cable is now ready for extruding a plug body about the connection between the lead ends and the contact prongs or pins.

It can thus be seen that the entire assembly can be provided for automated preparation of a cable length for extruding a plug body to one end, beginning from cutting the lengths from a long cable which is taken from a drum, up until extrusion in a final station which can but does not have to succeed directly the assembling steps and stations of the line along and in which the lengths are moved and worked in steps. Personnel is needed only in a general supervisory capacitor and, possibly, for inspecting the completed lengths with attached plugs and testing them. The lengths are not moved in separate containers from one station to the next one, except maybe to the extruder.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 shows a two-lead conductor or cable 1 whose two leads 2 and 3 have their respective ends connected to pins or prongs 4 and 5. The prongs 4 and 5 are mounted with one end in a plastic bridge 6. An insulative body constituting the plug has been extruded basically around the connection between the leads and the prongs but covering also the adjacent end portion of the cable jacket as well as the bridge. This is the completed product which has been made by means of equipment and installations to be described in the following.

FIG. 2 shows a drum 19 for the two-lead cable 1, and that cable is paid from the drum and fed, e.g., by a caterpillar capstan or the like, into and through a station 8 in which sequentially equal lengths are cut from the cable string. The cable is presumed to have a jacket around the two leads, and station 8 is also provided for de-jacketing the ends of the lengths as cut. The station 8 is conventional and does not require elaboration. Such a station is also known as Artos machine.

Figure 1:
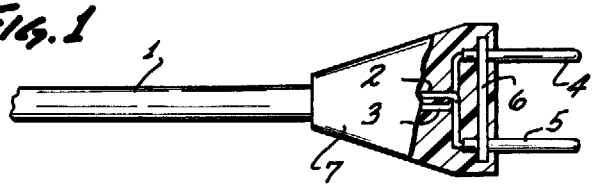
FIG. 1 is a side view, partially in longitudinal section of the plug to be made in accordance with the inventive process.

Station 8 places the cut lengths one after the other on a transport line 9 constructed, e.g., as two endless belts. These belts include holders 91 which receive the cable lengths and hold them in a stretched position. Reference numeral 10 denotes the direction of transport movement and the cable lengths are moved sequentially through the several stations 11 through 16 for processing.

The belts 9 are driven by a drive 92 which in turn is operated by a control device 93 for stepwise advance. In the most simple pattern, the several stations are equidistantly spaced along the travel path of belts 9, and the holding devices (grippers) 91 are spaced along these belts by the same distance, so that following each step of movement, a cable length is in each station and no cable length is worked. However, in the general sense, the grippers should be spaced at a particular distance from each other, so that the sequential lengths are spaced accordingly, and the respective distances from station to station should be integral multiples of that particular distance. Presently, the integer is "one" in all instances.

The step controller 93 may be operated by the belts themselves in that a scanner scans the passage of cable lengths and/or grippers at a particular location and stops the drive 92. The controller 93 may include a timer which issues clocking and timing or control pulses and in separate output lines following stopping and to be used in each station for control of the sequence of operational steps therein to be described. The step drive 92 is restarted after a number of timing pulses have issued from control 93 which is the maximum number of steps needed for any of the stations. Of course, the stations may have a greater degree of autonomie as far as control of their own operations are concerned; nevertheless, timing is needed to defer the next advancing step of conveyor 9 until the slowest working station has completed its work. The operation of the stations may be asynchronous and each may issue a completion signal, so that the conveyor 9 moves again only after all completion signals are in.

The leads 2 and 3 may be twisted and stripping the end portions of the jacket off does not untwist the exposed leads. Station 11 are provided to untwist the leads. However, even if the leads are not twisted (as shall be presumed), they have an arbitrary orientation after cutting and gripping and as they leave station 8.

The holding brackets 91 on line 9 are opened in stations 11, and the cable ends are gripped and rotated until the leads lie parallel to each other as shown in FIG. *3a*.

Figure 4:
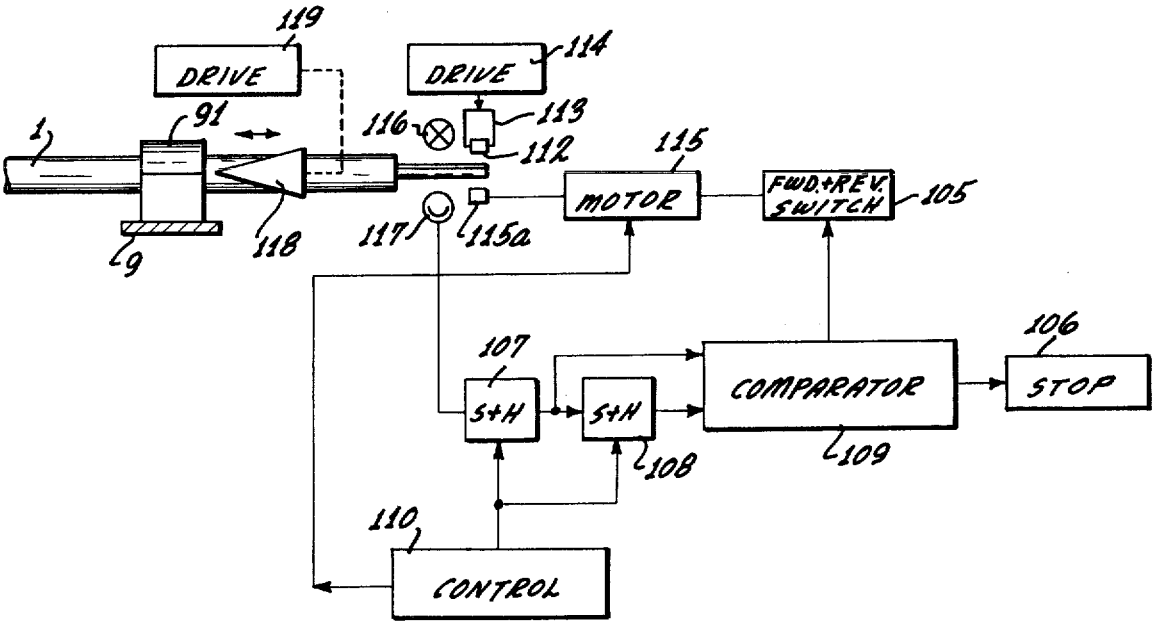
FIG. 4 is a schematic representation of the cable turning station.

FIG. 4 illustrates by way of example a station 11 and in greater detail. The cable lengths 1 arrive at the station, one at a time, while being held by grippers or brackets 91 on the belts such as 9. The transport line stops and timing control 93 takes over temporarily during stopping. Specifically, a holder engages the lead ends in that a rotatably mounted insert 112 engages the leads on its inside and urges them against a drum 115*a* of a stepping motor 115. The rolling insert or segment 112 is journalled in a carrier 113 which is advanced by a drive 114 after the lead ends have been placed in between insert 112 and drum 115*a* which occurs by operation of the transport, and upon stopping thereof.

The two leads as they arrive in station 11 have an undefined orientation. That orientation is slightly changed by the holding device 112/115*a*. As drive 114 advances insert 112, the lead ends as engaging drum 115*a* are oriented, but only temporarily and that orientation does not affect the leads in their entirety. The drive 114 is operated by a first timing pulse from control 93. The next timing and control signal from control 93 is applied to a drive 118 for a wedge element 119 which advances and spreads the jaws or brackets of gripper 91 to release the cable length from transport 9.

The leads 2, 3 as now held by device 112/115*a* extend across a light path originating from a lamp 116 and extending horizontally. The leads block and shade part of that light and provide an intensity modulation accordingly. The modulated light reaches a photoelectric detector 117. The modulation thus detected optically depends on the mutual orientation of the leads in the light path. A control circuit 110, private to station 11, responds to another timing pulse from central control 93 and begins to issue sample pulses alternating with step control pulses.

The first sample pulse reaches a sample and holds circuit 107 which is connected to detector 117. The step pulse provided thereafter causes motor 115 to move by one step, basically in an arbitrary direction, so that the cable is turned by a small angle, and the degree of shading the light path by the leads is slightly modified. The next sample path is again applied to sample and hold circuit 107 and also to a sample and hold circuit 108 receiving as an input the output of circuit 107. The latter receives now the detector signal following the modified light modulation by operation of the first turning step, and the signal level now set into circuit 108 represents the light modulation prior to that turning step by motor 115.

A comparator 109 is connected to the two circuits 107, 108 and compares the signal levels. If the later level (in 107) is higher, a reversing command does not issue, and the next motor control pulse from 110 causes the motor to move by one step in the same direction, because the cable length was and is turned in the correct direction. If the level in 107 is lower than in 108, comparator 109 issues a reversing command to a switch 105 which causes the next motor stepping pulse to be applied for operating the motor 115 in the reverse direction.

It appears from the foregoing that the motor 115 is operated to turn the cable, so that the leads shade the light path less and less, in other words, the cable with leads are turned towards a position of alignment in which one lead shades the other as that establishes minimum light obstruction and maximum light for detector 117. As the light path was horizontally oriented, this maximum light condition signifies orientation of the leads, side by side in a horizontal plane.

After the maximum light position has been reached, the next moving step will cause the light to be reduced again, so that the output of comparator 109 signals a reversing command to switch 105. The next motor pulse causes a turning back of the cable length to the desired end position.

The reversal at this point is monitored by a separate circuit 106 which monitors occurrance of a reverse command from comparator 109, but only after the first two motor control steps have occurred, because a first reversal may have occurred initially; the circuit had to find at first the correct direction for the motor to move the leads into the desired position of horizontal alignment. Thus, circuit 106 may be delayedly enabled from control 110 and its current response is a true indication that the desired orientation for the leads has been reached.

Circuit 106 when responding issues a stop command to control 110, so that no further motor stepping pulses issue. Also, drive 114 for carriage 113 is operated to retract carriage 113, so as to release the cable ends. This is followed by retraction of wedge 119, so that brackets 91 close again on the cable after the cable turning device has released the leads. The cable is now held and maintained on conveyor 9, so that the leads retain the desired position as shown in FIG. *3a*.

It should be mentioned that, for example, in the case of a three lead cable one of the leads is provided for a ground connection and must have a particular orientation with respect to the other two as well as to the ground connector prong. This particular ground wire lead will have a particular color distinct from the color of the other two leads. In that case, illumination and detection is provided from the same side, i.e., the detector 117 observes light reflected by the leads. Moreover, a color selective filter is placed in the light path to transmit the preferred color of the ground lead. The maximum amount of light will reach the detector 117, when that lead is in front of the detector. The axis of optical detection is, therefore, in the vertical.

The next station 12, also a double station strips insulation from the lead ends. Since the leads have already a particular orientation, it is merely required that stripping cutters be raised and lowered from opposite sides, strip the insulation and retract. It is not necessary that the holders 91 on belts 9 release the cable length for that operation.

Figure 3:
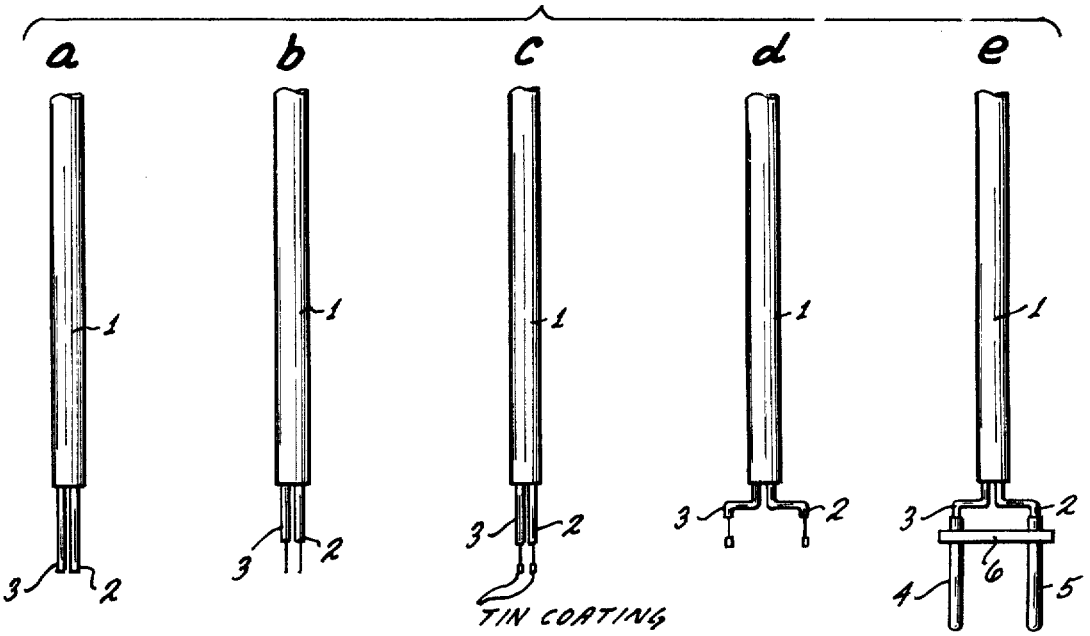
FIG. 3 shows in portions a through e the progressive preparation of a cable end for the extrusion process.
Figure 5:
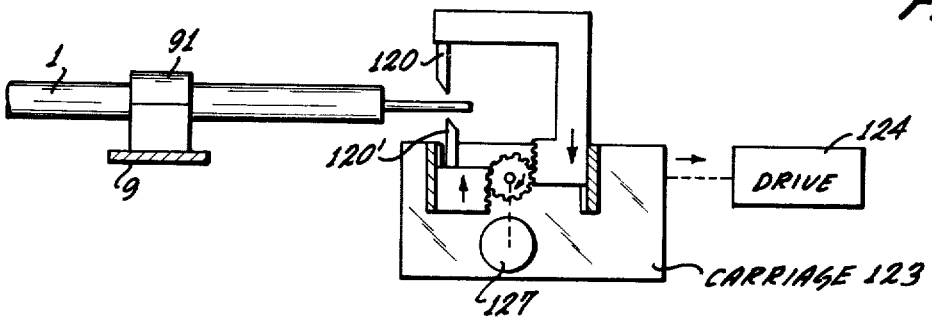
FIG. 5 is a schematic representation of the lead insulation stripping station.

FIG. 5 shows one of the stations 12 in greater detail. The cable arrives also here on transport 9 and stops when the leads are between cutters 120 and 120'. A double rack and pinion arrangement 121 driven by a reversible motor 122 causes the cutters to advance, and following engagement with the leads, a carriage 123 is retracted to the right in the drawing and by operation of a hydraulic drive 124, thereby stripping the insulation from the leads (FIG. 3*b*). After completion of this operation, rack and pinion drive 122 reverse followed by reversal of the hydraulic drive 124. The control may be provided from master control 93 as stated above, issuing stepping and control pulses and signals for the several stations, and triggering and sequencing the several drives in station 12 and the others.

Figure 6:
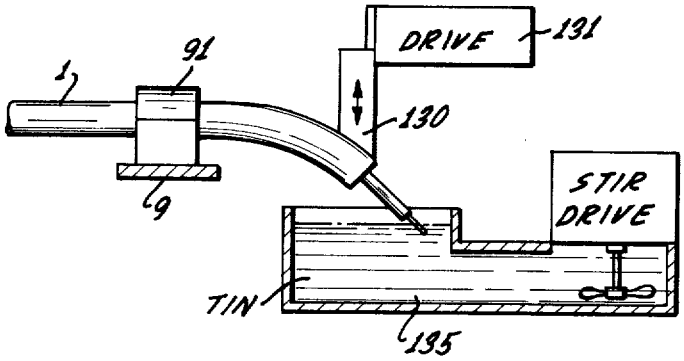
FIG. 6 is a schematic representation of the tin-plating station.

The next double station 13 is provided to strengthen the wire ends, for example, by tin-coating them (FIG. 6). For this, the wire ends pass first through wetting brushes or the like, possibly prior to reaching station 13. Upon stopping at that station, a plunger 130 is advanced by a hydraulic drive 131 and engages the lead ends, so that they are then bent down and dip into a tin bath 135 constructed e.g., as swelling bath. Bending down of the lead ends offers the added advantage that after the tin coated wire ends are removed from the bath, soldering lugs will not form. Such lugs could interfere with subsequent processing.

Figure 7:
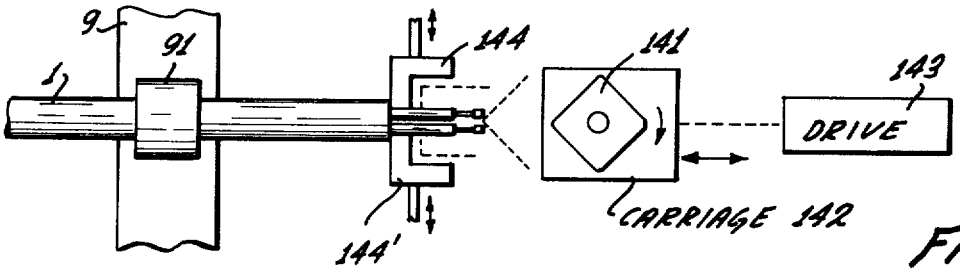
FIG. 7 is a schematic representation (top view) of the lead end forming station.

Prior to leaving station 13, the plunger 130 retracts and the wire ends are bent back; actually, they straighten under resilient reaction. The next stations will process further only one end of each cable length. Station 14 shown in FIG. 7 in top elevation bends the leads into oppositely oriented offset configurations as shown in FIG. 3*d*. The station has a die member 141 on a carriage 142 which is advanced by a drive 143. Member 141 serves as wedge to spread the leads apart in the same plane. Subsequently, die members 144, 144' advance laterally towards the leads and member 141 is turned to form the lead ends as shown in FIG. 3*d*. The lead ends are now particularly placed into a parallel, spaced apart position with a distance which is equal to the aperture spacing of a bridge and of the prongs, so that the lead ends can be placed in a flush orientation with such prongs which is carried out in the next station, 15.

The bridges have been separately preassembled in that each bridge 6 has been provided with a pair of prongs or pins 4, 5. In station 15, these prepared bridges and prongs are connected to the tin coated wire ends of cable length that has arrived. The prongs are assumed to be tubularly hollow, with open ends at the respective end adjacent the bridge and particularly where projecting rearwardly therefrom, so that the leads can be fastened just be squeezing the hollow prongs.

Figure 8:
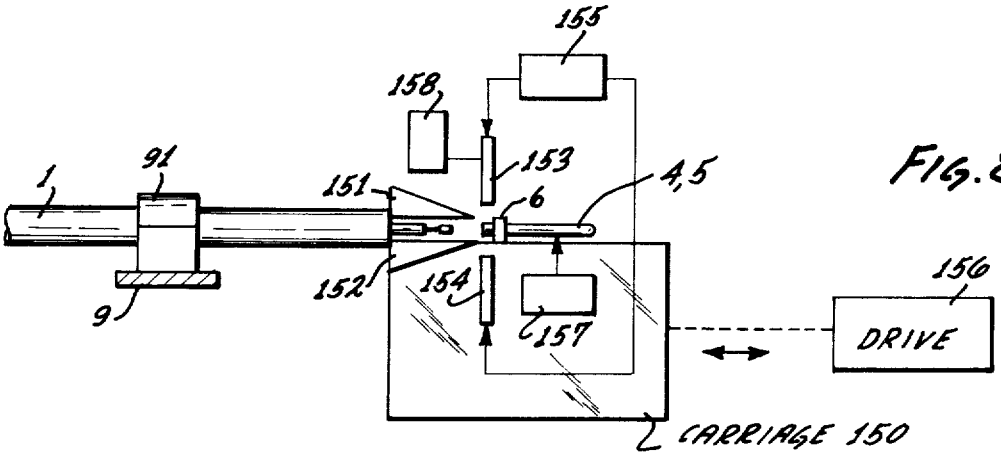
FIG. 8 is a schematic representation of the station, in which contact prongs are connected to the cable lead ends.

FIG. 8 shows details of station 15. The station 15 has a carriage 150, which is also movable transverse to the direction of transport of the cable lengths. A preassembled bridge with prongs is placed on the carriage in preparation for the step of connecting the prongs with the wire leads of the respective next length which will arrive in station 15. Carriage 150 has, preferably, a contoured bed, so that the bridge with prongs have a definite position therein.

The carriage 150 is provided additionally with two halves of a longitudinally biparted guide funnel 151, 152, of which the upper part is upwardly retractible. For the sake of clarity, funnel members 151, 152 are shown with the former in slightly lifted disposition, but in reality they rest on each other. A pair of flat (transverse to the drawing) plungers or punches 153, 154 is provided which are moved respectively up and down by a drive mechanism 155 which may be similar to device 121, but yields greater power.

In operation, the cable length with leads configured as shown in FIG. 3*d* stops in a position of alignment with carriage 150. The funnel is closed, a bridge with hollow prongs has been placed on the carriage 150. The carriage 150 advances to the left by operation of a hydraulic drive 156, whereby the wire leads are guided by the funnel and are threaded into the hollow ends of the prongs. The drawing illustrates an instant during this threading. It should be noted here that the funnel is somewhat exaggerated in the drawing. The next step following insertion of the leads into the prongs and stopping of the carriage 150 is the advance of press tools — plungers 153, 154 to squeeze the hollow prongs locally for clamping of the inserted wire leads.

Following the completion of mechanically connecting the cable leads with the contact prongs, tools 153 and 154 are retracted by 155, whereby a now energized electro-magnet 156 on 153 takes the upper funnel half 151 along. An ejector 157 in carriage 150 lifts the contact prongs and bridge slightly off the bed on carriage 150, so that the projecting lead ends clear also the lower funnel half 152. As the transport 9 resumes its advance, the length with connected contact prongs leave station 15. Upon deenergization of magnet 158, funnel part 151 drops back onto funnel part 152.

As the length of cable leaves station 15, its one end is configured as depicted in FIG. 3*e*. However, station 15 may additionally include a gripper, which grips the bridge and turns it by 180°, so that the leads cross over, as one can see by comparing FIG. 1 with FIG. 3*e*. Additionally, the leads 2 and 3 have a 90° curvature relative to the pins 4 and 5.

Station 16 provides for the extrusion of the plug element around the conductor and carrying the prongs with bridge. The bridge and a portion of the cable which was not stopped becomes fully embedded in the plastic body that is being extruded and, of course, the lead-to-prong connection is fully covered and arrested in its position. The extrusion station 16 is conventional.

The now completed length 18 with plug is released by the conveyor 9 and drops into a container 17. Each step brings one cable length to that point.

Figure 2:
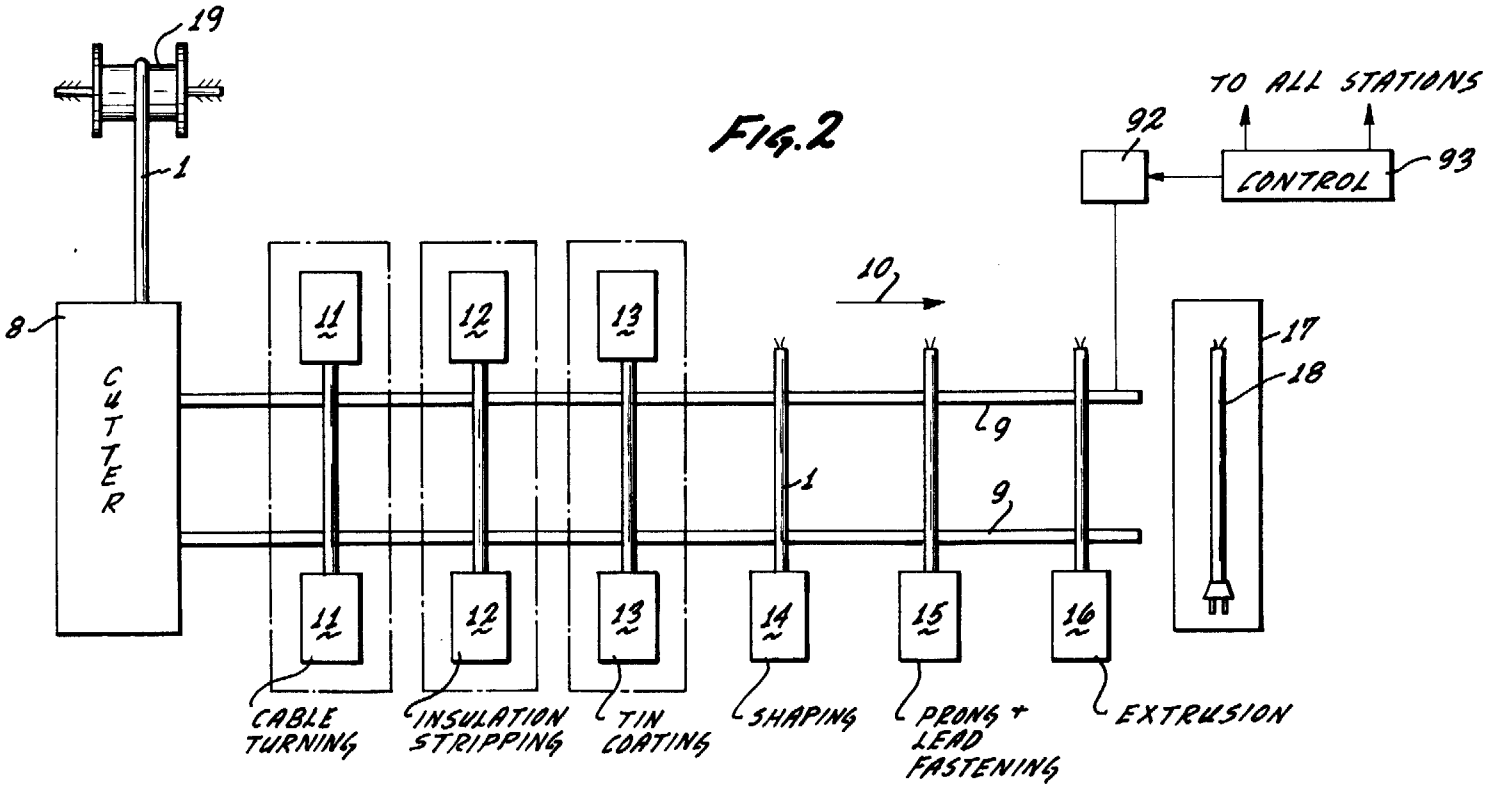
FIG. 2 is a schematic plan view of equipment in accordance with the preferred embodiment for carrying out that process.

The system as illustrated may be supplemented as follows. The specific station 12 illustrated in FIG. 2 may strip insulation only to the exact extent length of the wire later provided with tin coating. Following tin coating, i.e., after station 13, one may place another insulation stripping station, quite similar to station 12, but with a relative disposition of the stripping cutters, to remove more insulation, i.e., to bare a portion of the leads beyond the tin coated tips. This way the length of the wire end that is being strengthened is more accurately defined as the tin coating can extend only to the end of the first stripping. On the other hand, a certain portion of uncoated, bare wire is needed for a large area of contact making between wire and prongs, which is the reason for the second stripping station in that instant.

The method of this invention has been explained above with respect to a two lead cable. However, three or more lead cables may well be provided with a plug in accordance with the same method. Of course, the leads will then not simply be placed into one plane as per station 11, but must assume a position in which, e.g., three wires forming a triangle may be necessary, as was outlined above. In particular, the conductor which will become the ground conductor should be oriented above the three others which may have side by side position as shown in FIG. 3*b*. Exact positioning is particularly necessary to avoid damage to the wires by the insulation strippers. Otherwise the method is analogous to the one described.

In accordance with another modification stations 14 and 15 could be combined. In other words, shaping the lead ends and attaching the contact prongs could be carried out in one station.

The salient features of the inventive method are carried out in stations 11 through 15, which amounts to a particular sequence of preparatory steps preceding the extrusion of the plug body. Actually, that extrusion could be carried out later and elsewhere. Thus, the specific sequence could be terminated with station 15, from which the cable lengths drop into basket 17. Such an arrangement would be of specific interest if existing extrusion machines are to be used, but they do not fit into the automatic assembly line as outlined above. On the other hand, a testing station may be added to test adequacy of contact making and to remove any faulty unit. Moreover, visual inspection was found to be quite adequate.

The stations 14, 15 and 16 are placed only to one side of conveyor facility 9. However, the other ends of the cable lengths can be provided with receiver plugs, using analog stations to fasten female contacts to the leads.

The invention is not limited to the embodiments described above, but all changes and modifications thereof not constituting departures from the spirit and scope of the invention are intended to be included.

We claim:

1. In a method for providing a plug element by means of extrusion to the ends of a plurality of lengths of electrical cable each having a plurality of leads and wherein each such length has to be prepared prior to extruding said element, and wherein a portion of each length, at least at one end, has its jacket removed to expose the insulated leads for a certain length, comprising the steps of:

positioning the lengths of cable in particular, spaced apart positions and moving the lengths in steps through a plurality of stations, said stations performing particular working steps including:

a. turning the exposed leads at least at one end of a length, so that the leads assume a predetermined orientation for and during the continuation of moving the length to the next and other stations;

b. stripping the insulation of a portion of the leads as oriented to expose the wire;

c. strengthening the tips of the exposed wires;

d. shaping the lead ends with exposed and strengthened wire to assume an orientation and a disposition flush with the position of prongs in the completed product; and e. connecting the prongs to said wires.

2. In a method as in claim 1, wherein the strengthening step is a dipping step to coat the bared leads at least at their tips.

3. In a method as in claim 2, wherein another stripping step is interposed between steps (c) and (d).

4. In a method as in claim 3, wherein the dipping step is performed as tin coating step.

5. In a method as in claim 2, wherein the bared leads are temporarily bent off to obtain the dipping.

6. In a method as in claim 2, wherein the shaping step is succeeded or the connecting step is preceded by a step of turning the lead ends with attached prongs by 180° relative to the axis of the respective cable length.

7. In a method as in claim 1, wherein the steps (d) and (e) are performed in a single station.

8. In a method as in claim 1, wherein the step (a) includes optically detecting the extent of misalignment of the leads and stopping the turning upon detecting that the leads extend parallel to each other and in a particular plane.

9. In a method as in claim 1, wherein the step (e) is preceded by a step of assembling a pair of prongs in a bridge and placing the assembly into specific position of stopping of a cable length in the station performing step (e).

* * * * *